US005443318A

United States Patent [19]

Kitazawa

[11] Patent Number: 5,443,318

[45] **Date of Patent: * Aug. 22, 1995**

[54] PRINTING DEVICE FOR PRINTING IMAGE ON TAPE LIKE MEMBER

[75] Inventor: Yasunori Kitazawa, Anjou, Japan

[73] Assignee: Brother Kogyo Kabushiki Kaisha, Aichi, Japan

[ * ] Notice: The portion of the term of this patent subsequent to Apr. 12, 2011 has been disclaimed.

[21] Appl. No.: 126,267

[22] Filed: Sep. 24, 1993

Related U.S. Application Data

[63] Continuation of Ser. No. 898,239, Jun. 12, 1992, which is a continuation of Ser. No. 695,566, May 3, 1991, Pat. No. 5,302,034.

[51] Int. Cl.[6] ..... B41J 2/00

[52] U.S. Cl. ..... 400/120.01; 400/207; 400/188

[58] Field of Search ..... 400/207, 208, 120, 188

[56] References Cited

U.S. PATENT DOCUMENTS

| | | | |
|---|---|---|---|
| 4,568,951 | 2/1986 | Hasegawa et al. | 400/323.1 |
| 4,652,154 | 3/1987 | Horiya et al. | 400/208 |
| 4,836,698 | 6/1989 | Takagi et al. | 400/217 |
| 4,927,278 | 5/1990 | Kuzuya et al. | 400/208 |
| 5,009,530 | 4/1991 | Kuzuya et al. | 400/120 |
| 5,078,528 | 1/1992 | McGourty et al. | 400/207 |
| 5,302,034 | 4/1994 | Kitazawa | 400/207 |

FOREIGN PATENT DOCUMENTS

| | | | |
|---|---|---|---|
| 05863494 | 4/1983 | Japan | 400/207 |
| 0093376 | 5/1984 | Japan | 400/207 |

*Primary Examiner*—Edgar S. Burr
*Assistant Examiner*—Anthony H. Nguyen
*Attorney, Agent, or Firm*—Kane, Dalsimer, Sullivan, Kurucz, Levy, Eisele and Richard

[57] ABSTRACT

A printing device for selectively printing a normal posture character image or reverse posture character image on a tape like image receiving member by using a thermal head. In the normal posture character image printing, a non-lamination type printing tape is used in which an imaging surface is exposed to an atmosphere, and in the reverse posture character image printing, a lamination type printing tape is used in which the imaging surface is protected by a transparent tape. A tape cartridge which stores the non-lamination type printing tape and another tape cartridge which stores the lamination type printing tape are both commonly assembleable to an accommodation portion of the printing device. In accordance with the kind of the assembled tape cartridge, normal or reversed character image is printed on the tape.

4 Claims, 5 Drawing Sheets

PRINTING DEVICE FOR PRINTING IMAGE ON TAPE LIKE MEMBER

The present application is a continuation of application Ser. No. 898,239 filed Jun. 12, 1992 which in turn is a continuation of application Ser. No. 695,566, filed May 3, 1991, now U.S. Pat. No. 5,302,034.

BACKGROUND OF THE INVENTION

The present invention relates to a printing device for printing an image on a tape-like member.

Conventionally, a printing device for printing an image on a tape like image receiving member has been proposed. According to the conventional printing device, a tape cartridge which accommodates therein a tape and an ink ribbon is assembled in a main body of the printing device for printing an image on the tape. U.S. Pat. No. 4,815,871 discloses such printing device in which a normal character image is printed on a non-adhesive surface of an adhesive tape provided with a releasable sheet, the printed surface being directly exposed to an atmosphere (this printing can be referred to as "non-lamination type printing" in which the imaging surface is not covered with any lamination layer for the purpose of image protection). Here, the "normal character image printing" implies that the printed image has a normal posture when viewing the resultant printed tape from the imaging side (see FIG. 6(*a*)). The tape printed with the image is adhered to a tape receiving member in such a manner that the printed image is directly exposed to the atmosphere.

On the other hand, U.S. Pat. No. 4,927,278 discloses another type of printing to the tape like member. The tape employed has transparency to which a reversed character image is printed. The imaging surface of the transparent tape is superposed with dual sided adhesive tape provided with a releasable sheet (this printing can be referred to as "lamination type printing" in which the imaging surface is covered with another tape for the purpose of image protection). Here, the "reversed character image printing" (FIG. 6(*b*)) implies that the printed image has a normal posture when viewing the resultant printed tape from a side opposite the imaging side. When the printed tape is adhered to a tape receiving member, the transparent tape is positioned as a top layer which protects the imaging surface, and the initially reversed image is then visible through the transparent tape in the normal character image.

The lamination type printing has advantages in that the imaging surface can be protected by the top layer, to thereby enhance durability of the printed portion. However, this also provides drawback in that the structure of the tape cartridge becomes complicated, which leads to high production cost. In case of the non-lamination type printing, in contrast, even though simplified arrangement for the printing device can be provided, the printed surface is not protected by any laminated layer but is exposed to the atmosphere, to thereby degrade its durability. Accordingly, conflicting problems exists in both lamination type and non-lamination type printing methods.

According to the conventional tape printing device, different kinds of printing device have been prepared. In other words, one type of printing device is exclusively used for the non-lamination type print, and another type of printing device is exclusively used for the lamination type printing, and compatible printing device, especially, a compatible tape cartridge has not yet been provided. More specifically, if a tape cartridge for the lamination type is installed in a non-lamination type tape printer which provides the normal character image on the tape and printing is carried out to the tape, resultant printing image on the tape receiving member is reversed, since the imaging surface is observed from a side opposite the imaging surface of the tape. On the other hand, if a tape cartridge for the non-lamination type is installed in the lamination type tape printer which provides the reverse character image on the tape and printing is made, the reverse character image is to be observed when the tape is adhered to the tape receiving member, since the imaging surface is directly observed from the imaging surface. Consequently, the lamination type and non-lamination type printers must be separately prepared if non-lamination type and lamination type are both intended to be printed.

SUMMARY OF THE INVENTION

It is therefore, an object of the present invention to overcome the above described drawbacks and to provide an improved printing device for printing an image on a tape-like member, the printing device being capable of selectively performing the lamination type and non-lamination type printings.

This and other object of the present invention will be attained by providing a printing device for printing an image on a tape like image receiving member comprising (a) a feeding mechanism for feeding the tape like image receiving member in a first direction, (b) a print head having an array of a plurality of ink transferring elements for transferring an ink to the tape like image receiving member to provide an inked image thereon, the array extending in a second direction perpendicular to the first direction, (c) memory means for storing therein character patterns, (d) a print head driving means connected to the print head for selectively driving at least one of the ink transferring elements in accordance with a printing data and a character pattern read from the memory means, (e) signal generation means for generating one of first and second print mode signals, in the first print mode the tape like image receiving member comprising a tape member having one surface formed with adhesive layer to which a releasable tape is formed and another surface to which the inked image is formed, and in the second printing mode the tape like image receiving member comprising a transparent tape having one surface, the inked image being formed on the one surface and a dual sided adhesive tape formed with a releasable tape being also formed on the one surface, (f) switching means connected to the print head driving means for reversely driving the ink transferring elements with respect to the second direction in order to turn the character pattern from side to side with respect to the second direction, and (g) control means for selectively actuating the switching means in response to the signal from the signal generation means.

In another aspect of the invention, there is provided a printing device for printing an image on a tape like image receiving member comprising (a) accommodation portion for installing thereon the tape like image receiving member and an ink ribbon, the accommodation portion commonly installing a first kind of a tape like image receiving member on which a normal character image is to be printed and a second kind of a tape like image receiving member on which a reversed character image is to be printed, (b) a feeding mechanism for feeding the tape like image receiving member in a first direction, (c) a print head having an array of a plurality of ink transferring elements for transferring an ink to the tape like image receiving member to provide an inked image thereon, the array extending in a second direction perpendicular to the first direction, (d) memory means for storing therein character patterns, (e) a print head driving means connected to the print head for selectively driving at least one of the ink transferring elements in accordance with a printing data and a character pattern read from the memory means, and (f) switching means connected to the print head driving means for reversely driving the ink transferring elements with respect to the second direction in order to turn the character pattern from side to side with respect to the second direction when the second kind of the tape like image receiving member is installed in the accommodating portion.

In the printing device according to this invention, the signal generation means generates one of first and second print mode signals dependent on the intended printing mode. In the first print mode the tape like image receiving member comprises a tape member having one surface formed with adhesive layer to which a releasable tape is formed and another surface to which an inked image is formed. In the second printing mode the tape like image receiving member comprises a transparent tape having one surface, and a dual sided adhesive tape formed with a releasable tape at one surface thereof. The inked image is formed on the one surface of the transparent tape to which the other surface of the dual sided adhesive tape is provided. The control means will determine in response to the signal from the signal generation means as to whether or not the switching means is to be operated so as to reversely supply character pattern data to the print head driving means in such a manner that the ink transferring elements are driven in a reverse order with respect to a direction of the array thereof to produce the reverse character image.

DETAILED DESCRIPTION OF THE PREFERRED EMBODIMENTS

A printing device according to one embodiment of this invention will be described with reference to FIGS. 1 to 6(*b*).

Figure 1:
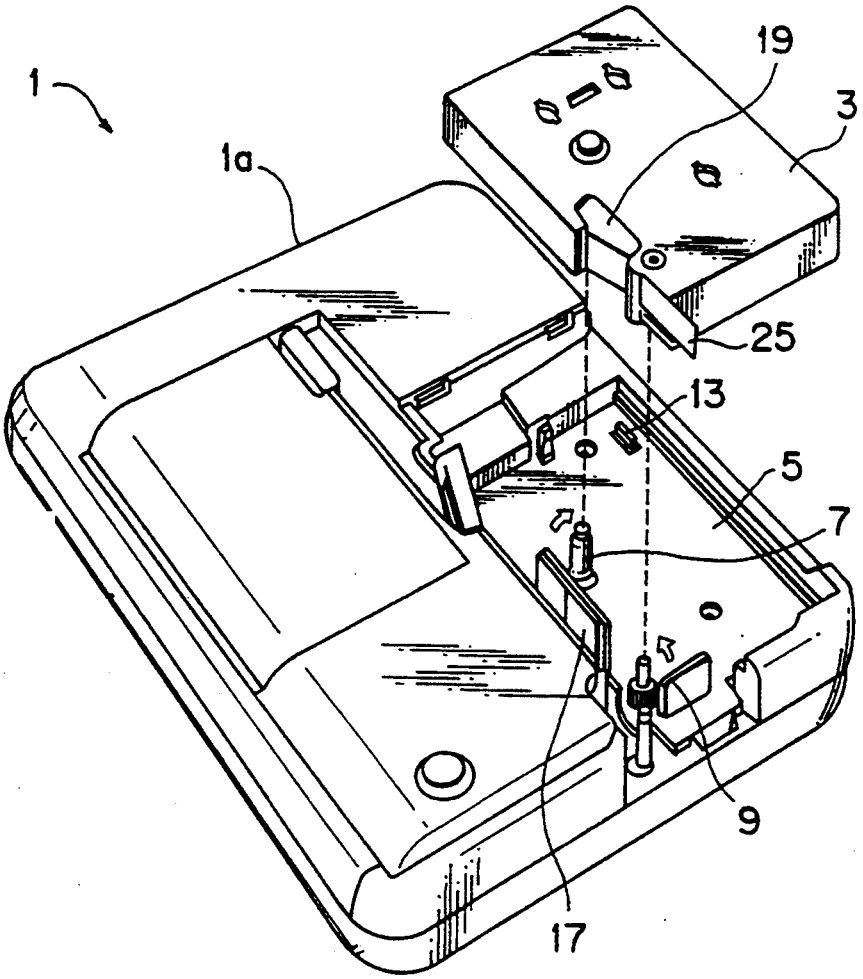
FIG. 1 is a partly exploded perspective view showing a printing device and its tape cartridge according to one embodiment of this invention.

FIG. 1 shows a rear perspective view of the printing device 1. The printing device includes a tape cartridge holding portion 5 for holding a tape cartridge 3 formed with an opening portion 19 and installing a printing tape 25. In the tape cartridge holding portion 5, a ribbon take-up cam 7 and a tape feed roller cam 9 are provided. These cams 7 and 9 are drivingly coupled to a drive motor 11 (FIG. 4) housed within an outer frame 1*a* of the printing device, and are rotatable in directions indicated by arrows in FIG. 1. The tape cartridge holding portion 5 is further provided with a movable projection 13 movable in a vertical direction. The movable projection 13 is normally biased toward the rear wall of the outer frame 1*a* (upwardly in FIG. 1). However, when the movable projection 13 is urged to be depressed into an interior of the frame 1*a*, the projection 13 will actuate a detector 15 (FIG. 4) provided within the outer frame 1*a* and connected to a control means described later with reference to FIG. 4) of the printing device 1.

Figure 5:
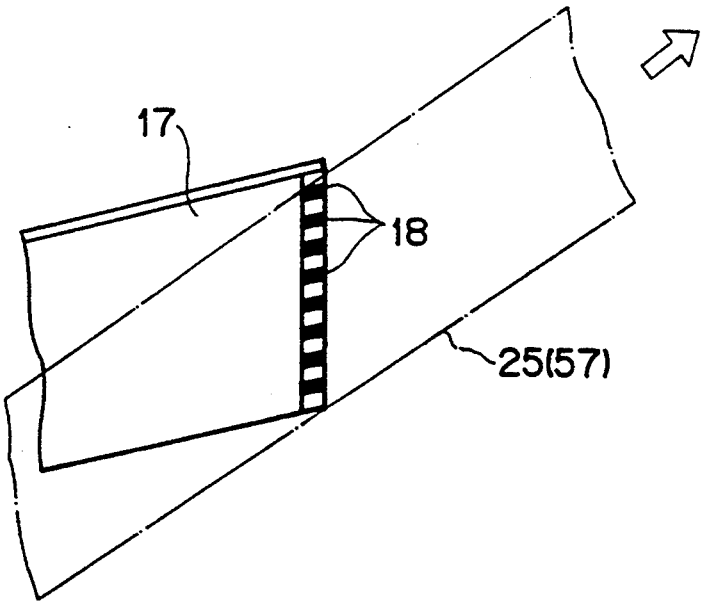
FIG. 5 is a perspective view particularly showing a thermal head according to one embodiment of this invention FIG. 6(*a*) is a plan view showing a printed tape in which a normal character images are printed.

The tape cartridge holding portion 5 is also provided with a thermal head 17. The thermal head 17 is adapted to be confronted with the opening portion 19 of the tape cartridge 3 when the latter is assembled to the tape cartridge holding portion 5. The thermal head 17 is provided with an array of a plurality of heat generating elements 18, the array being directed perpendicular to a feeding direction of the printing tape as best shown in FIG. 5.

Figure 2:
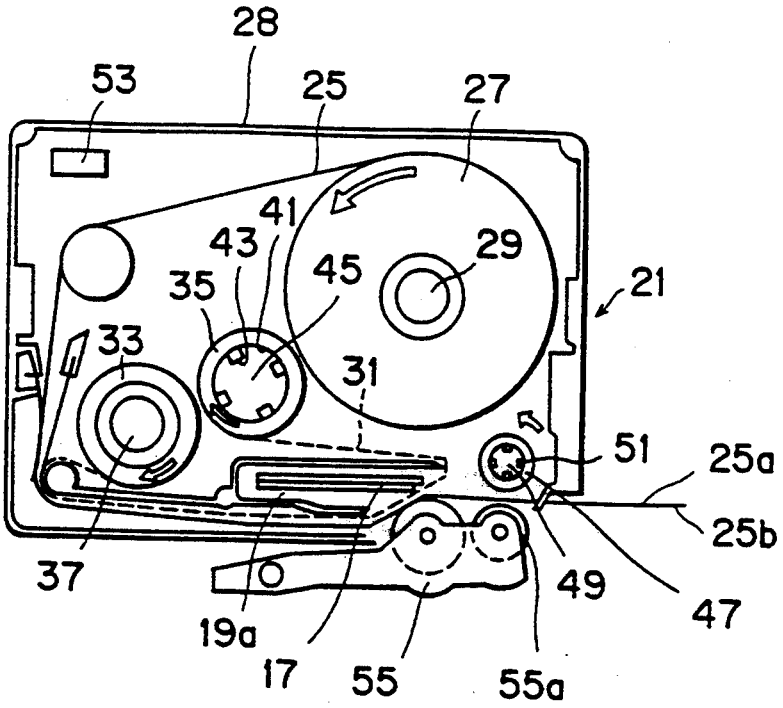
FIG. 2 is a plan view showing an internal arrangement of a tape cartridge in which a normal character image can be printed according to one embodiment of this invention.
Figure 3:
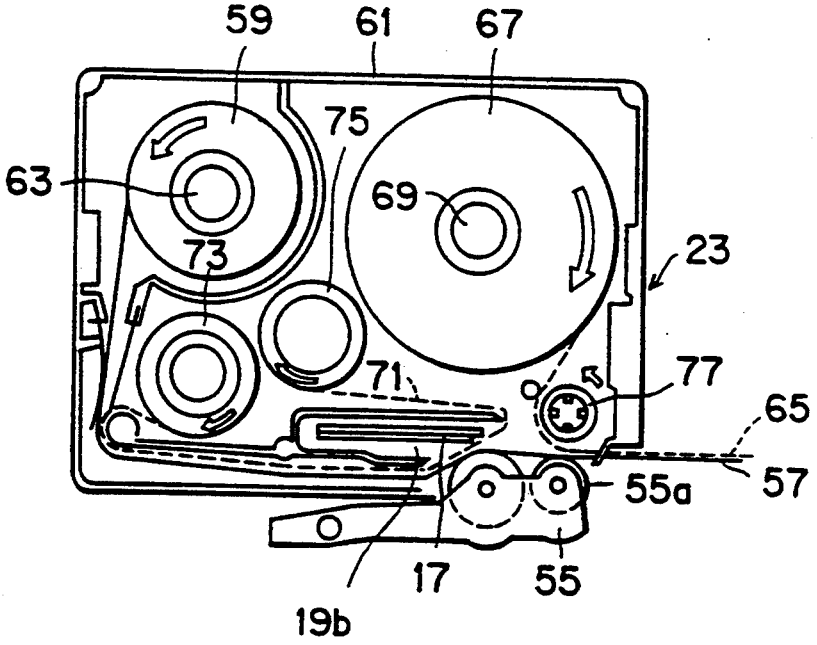
FIG. 3 is a plan view showing an internal arrangement of another tape cartridge in which a reverse character image can be printed according to one embodiment of this invention.

For the tape cartridge 3, two different kinds of the tape cartridges, i.e. a non-lamination type tape cartridge 21 and a lamination type tape cartridge 23 are prepared as shown, respectively in FIGS. 2 and 3.

Referring first to the non-lamination type tape cartridge 21 shown in FIG. 2, a rotation shaft 29 is rotatably provided over which a rolled printing tape 25 is wound in a form of a tape roll 27. As described above, the printing tape 25 has one printing surface 25*a* to which an image formed by the thermal head 17 and an opposite surface at which adhesive layer is formed to adhere a releasable tape. Within the tape cartridge 21, provided are an ink ribbon roll 33 of an ink ribbon 31 whose one surface is coated with an ink, and a take-up spool 35 to which a leading end of the ink ribbon 31 is fixed. The ink ribbon roll 33 is wound over a ribbon roll shaft 37 rotatably supported by a cartridge case 28. The take-up spool 35 has an inner peripheral surface 41 at which engaging protrusions 43 are protruded radially inwardly. The take-up spool 35 is rotatably supported by a hole 45 formed in the cartridge case 28. This ink ribbon take-up spool 35 is provided engageable with the ink ribbon take-up cam 7 when the take cartridge 21 is assembled into the tape cartridge holding portion 5.

The printing tape 25 and the ink ribbon 31 are both fed to the opening portion 19*a*. However, after these are fed past the opening portion 19*a*, the ink ribbon 31 is directed to the ink ribbon take-up spool 35 as shown by a broken line in FIG. 2 whereas the printing tape 25 is discharged out of the cartridge case 28.

The printing surface 25*a* of the printing sheet 25 confronts the inking surface of the ink ribbon 31. When the tape cartridge 21 is assembled to the tape cartridge holding portion 5 of the printing device 1, the printing tape 25 and the ink ribbon 31 are brought into pressure contact with each other at the opening portion 19*a* by the thermal head 17 and a pressure contact/release member 55. In this case, the printing surface 25*a* of the printing tape 25 is confronted fronted with the thermal head 17. In other words, the printing surface 25*a* is positioned at radially inner side of the tape roll 27, and the inking surface of the ink ribbon 31 is positioned at radially outer side of the ink ribbon roll 33.

In the tape cartridge 21, a tape feed roller 47 is rotatably provided at a position adjacent the opening portion 19*a*. This tape feed roller 47 is rotatably secured to a hole 49 formed in the cartridge case 28, and engagement protrusions 51 are radially inwardly protruded from an inner peripheral surface of the tape feed roller 47. When the tape cartridge 21 is assembled to the tape cartridge holding portion 5 of the printing device 1, the engagement protrusions 51 of the tape feed roller 47 are brought into engagement with the tape feed roller cam 9. The tape feed roller 47 is positioned in confrontation with a rotatable roller 55*a* secured to the pressure/-release member 55.

Further, a rectangular hole 53 is formed in the cartridge case 28. This rectangular hole 53 is positioned so that the movable projection 13 is aligned therewith when the tape cartridge 21 is assembled to the tape cartridge holding portion 5. In this assembling state, the movable projection 13 is positioned within the rectangular hole 53. Therefore, the protruding state of the movable projection 13 is maintainable (a wall of the tape cartridge does not depress the movable projection 13 into the interior of the frame 1*a*, i.e., upward position of the movable projection 13 in FIG. 1 can be maintained).

Upon assembly of the tape cartridge 21 into the tape cartridge holding portion 5, the ink ribbon take-up cam 7 and the tape feed roller cam 9 are engaged with the ink ribbon take-up spool 35 and the tape feed roller 47, through the protrusions 43 and 51, respectively, and these are rotated in directions indicated by arrows in FIG. 2. In this case, the tape feed roller contacts the printing tape 25 under pressure in cooperation with the rotatable roller 55*a* of the pressure contact/release member 55. By the rotation of the tape feed roller 47, the printing tape 25 is discharged out of the tape cartridge 21.

Figure 6A:
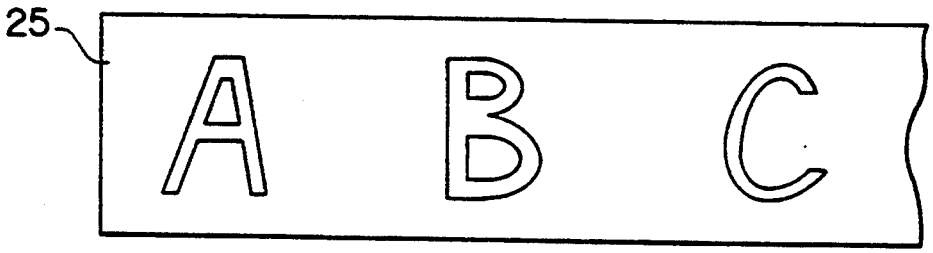
FIG. 6(*b*) is a plan view showing a printed tape in which a reversed character images are printed.
Figure 6A:
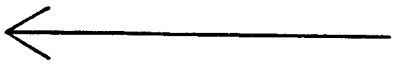
Figure 6B:
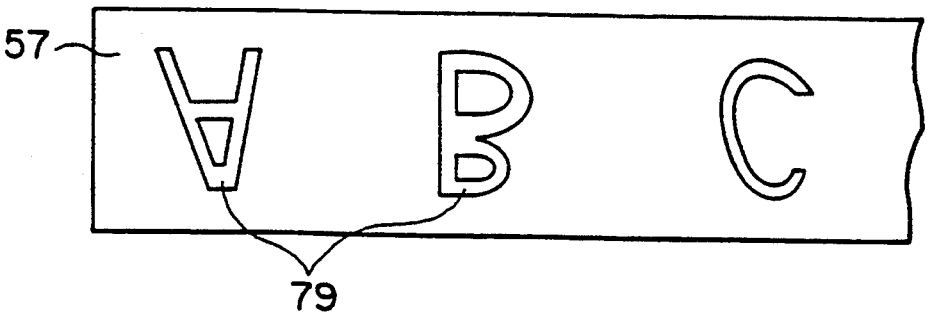

In view of the foregoing, according to the tape cartridge 21 shown in FIG. 2, when it is assembled to the printing device 1, the printing surface 25 is subjected to printing by the thermal head 17 through the ink ribbon 31. The selective actuations of the heat generating elements 18 of the thermal head 17 produce normal image as shown in FIG. 6(*a*) on the printing surface 25*a* opposite the releasable tape side 25*b* by thermally transferring ink of the ink ribbon 31 to the printing surface 25*a*, and the printed tape 25 is discharged by the rotation of the tape feed roller 47.

Next, a lamination type tape cartridge 23 will be described with reference to FIG. 3. The tape cartridge 23 has a cartridge case 61 at which a rotation shaft 63 is provided. A tape roll 59 of a printing tape 57 is rotatably wound over the rotation shaft 63. The printing tape 57 is formed of a transparent film-like material, so that even if a reversed image is printed on one printing surface of the transparent tape 57 the printed image is visible as a normal image when viewing it from the opposite surface of the transparent tape 57. The printing tape 57 can be introduced into an opening portion 19*a* by a guide member provided in the cartridge case 61.

In the tape cartridge 23, another rotation shaft 69 is rotatably provided, and a roll 67 of a dual sided adhesive tape 65 is wound over the rotation shaft 69. The dual sided adhesive tape 65 has both front and rear surfaces formed with adhesive agent, and a releasable tape is adhered to one adhesive surface thereof. Moreover, similar to the non-lamination type tape cartridge 21, there are provided an ink ribbon roll 73 of an ink ribbon 71, a take-up spool 75 for winding the ink ribbon 71 and a tape feed roller 77 for feeding the printing tape 57.

Upon assembly of the tape cartridge 23 into the tape cartridge holding portion 5, the printing tape 57 is urged to be depressed onto the thermal head 17 through the ink ribbon 71 by the pressure contact/release member 55. Further, the printing tape 57 and the dual sided adhesive tape formed with the releasable tape are interposed between the tape feed roller 77 and the rotatable roller 55*a*. When the tape feed roller 77 is rotated in a direction indicated by an arrow in FIG. 3, the printing tape 57 and the dual sided tape 65 are discharged from the tape cartridge 23. In this case, the printing surface of the printing tape 57 is in facial contact with the adhesive layer of the dual sided adhesive tape 65. Thus, the printing tape 57 and the dual sided tape 65 becomes integral with each other at the tape discharge.

In the lamination type tape cartridge 23, the printing tape 57 is integral with the dual sided adhesive tape 65, and the printed or imaging surface of the printing tape 57 is protected by the adhesive tape 65. The printed image is observed from a side opposite the printed surface. To this effect, the thermal head 17 produces a reversed image on the printed surface of the tape 57 as shown in FIG. 6(*b*). The reversed image is provided by turning the normal image by 180 degrees with respect to a line perpendicular to the tape feeding direction indicated by an arrow in FIG. 6(*b*). In other words, the reversed image is turned by 180 degrees from the normal image position with respect to a direction of an array of the heat generating elements 18 of the thermal head 17.

It should be noted that the lamination type tape cartridge 23 is not formed with a hole corresponding to the rectangular hole 53 shown in FIG. 2. Therefore, when the tape cartridge 23 is assembled into the tape cartridge holding portion 5, the wall of the tape cartridge 23 abuts the movable projection 13 and depresses the movable projection 13 into the interior of the frame 1*a* against the biasing force applied to the projection 13.

Figure 4:
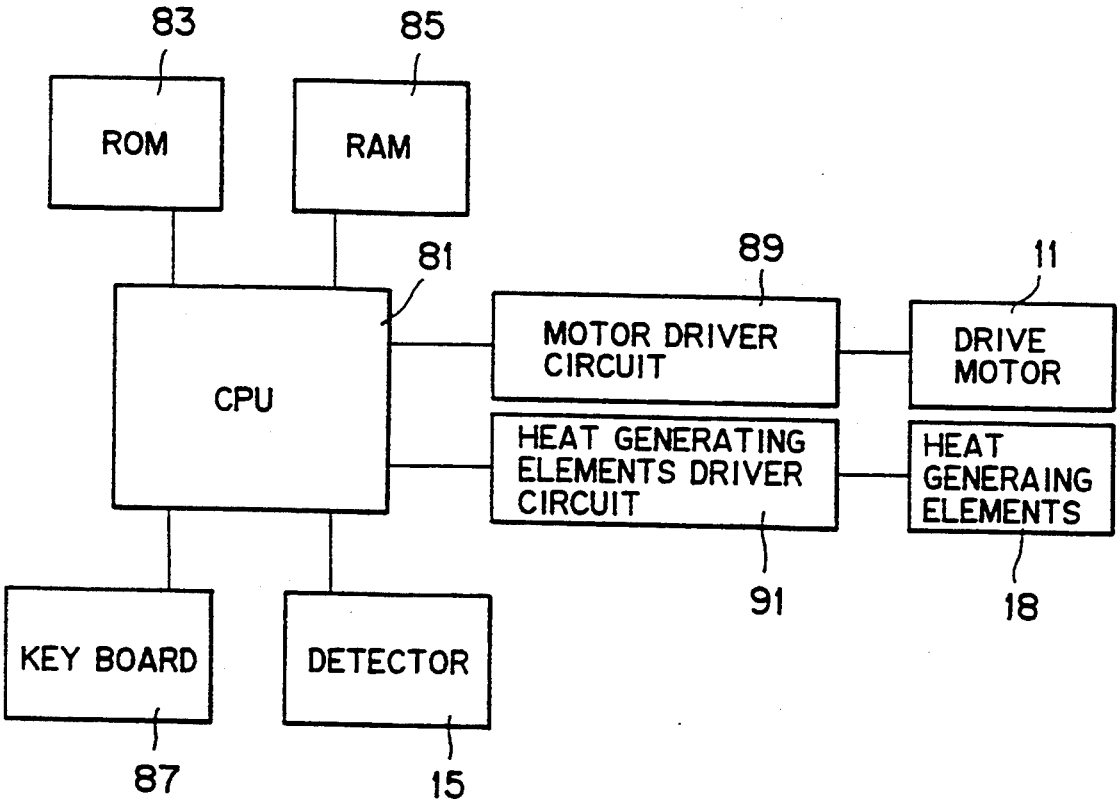
FIG. 4 is a block diagram showing a control circuit of the printing device according to one embodiment of this invention.

FIG. 4 shows one example of a control arrangement applied to the printing device 1 which can selectively provide normal or reversed image with selective employment of the non-lamination type tape cartridge 21 or the lamination type tape cartridge 23. According to the control arrangement, a CPU 81 is provided for overall processing, and to the CPU 81 connected are ROM 83, a RAM 85, a key board 87, the detector 15, a motor driver circuit 89 and a heat generating element driver circuit 91. The motor driver circuit 89 is connected to the drive motor 11, and the heat generating element driver circuit 91 is connected to the heat generating elements 18 of the thermal head 17.

The ROM 83 stores therein a program which control operations of the CPU 81 and character patterns for the character printing. The key board 87 is adapted for inputting the print character data into the CPU 81 for obtaining a desired print character image. As described above, the detector 15 detects the movable projection 13. That is, if the non-lamination type tape cartridge 21 is assembled to the printing device 1, the movable projection 13 is not depressed into the interior of the frame 1*a*. Therefore, the detector 15 does not detect the movable projection 13, which is indicative of the assembly of the non-lamination type tape cartridge. On the other hand, if the lamination type tape cartridge 23 is assembled, the movable projection 13 is depressed into the interior of the frame 1*a*. Therefore, the detector 15 detects the movable projection 13, which is indicative of the assembly of the lamination type tape cartridge 23. Thus, the CPU 81 can determine, through the detector 15, as to which one of the tape cartridges is installed in the printing device 1. The motor driver circuit 89 is adapted to control the drive motor 11 in accordance with a tape feed data sent from the CPU 81. The tape feed data is provided upon manipulation to the key board 87. The heat generating element driver circuit 91 controls actuations of the respective heat generating element 18 in response to the character print data sent from the CPU 81. The CPU 81 provides the character print data in such a manner that order of the elements 18 in the array is selectively reversed in accordance with the result of the detection of the movable projection 13 by the detector 15.

With this arrangement, if the non-lamination type tape cartridge 21 is assembled to the holding portion 5, the movable projection 13 maintains its protruding state. Therefore, the detector 15 does not detect the projection 13. Therefore, determination in the CPU 81 falls that the non-lamination type tape cartridge 21 is installed, and the normal character printing is to be carried out. Accordingly, the CPU 81 transmits data indicative of the normal character printing to the heat generating element driver circuit 91. In this case, the direction of one character is coincident with the direction of the array of the heat generating elements 18 (downwardly in FIG. 5).

On the other hand, if the lamination type tape cartridge 23 is installed in the printing device 1, the movable projection 13 is depressed inwardly by the wall of the cartridge 23, so that the detector 15 can detect the projection 13. Therefore, determination in the CPU 81 falls that the lamination type tape cartridge 23 is installed and the reverse character printing is to be carried out. Accordingly, the CPU 81 transmit data indicative of the reverse character printing to the heat generating element driver circuit 91. In this case, the direction of one character is opposite the direction of the array of the heat generating elements 18.

Of course, the manipulation to the key board 87 will provide the intended character images while feeding the printing tape. The releasable tape adhered to the printing tape 25 or the dual sided tape 65 is removed, so that the adhesive layer is exposed and the printing tape can be adhesively attached to an intended object or a tape receiving member.

Figure 7:
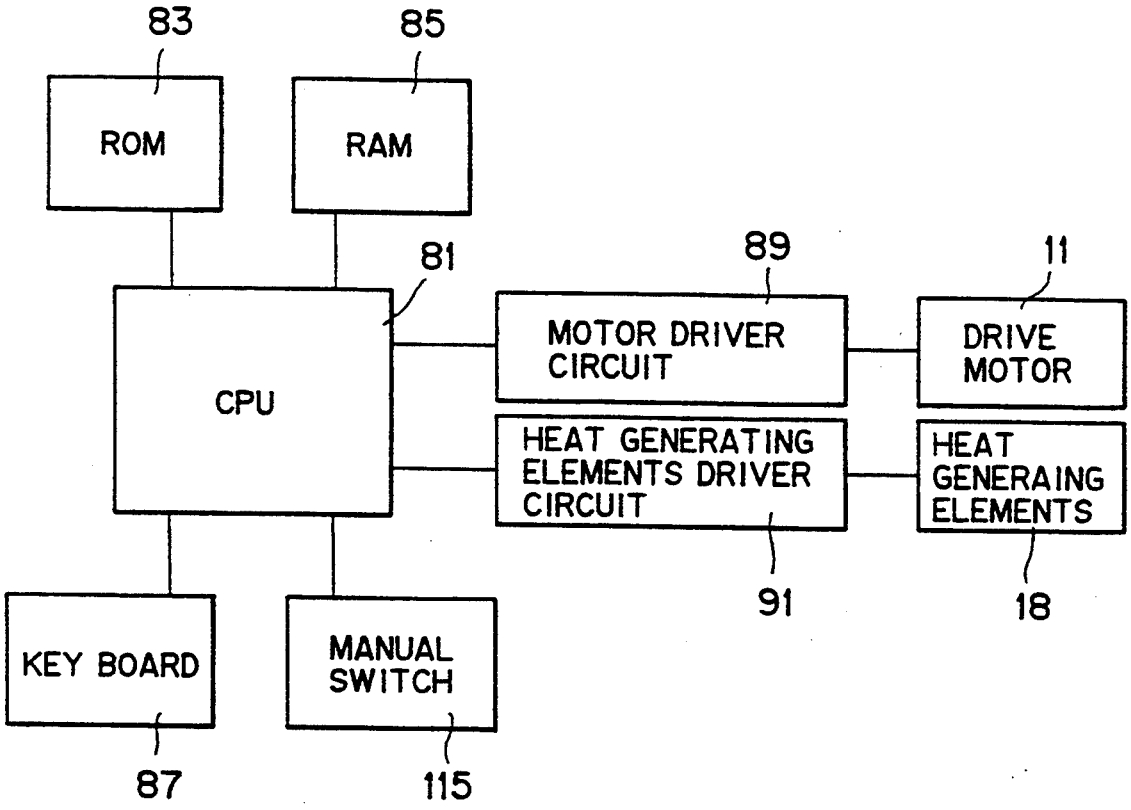
FIG. 7 is a block diagram showing another control circuit incorporated in the printing device according to the present invention.

FIG. 7 shows a control arrangement according to a second embodiment of this invention. In the first embodiment described above, the movable projection 13, the hole 53 and the detector 15 are provided so as to automatically judge the kind of the tape cartridge. However, in the second embodiment, such parts or elements are dispensed with. Instead, a manual switch 115 is provided so that an operator can manually select normal character printing or reverse character printing in accordance with the installation of the non-lamination type or lamination type tape cartridge. As shown in FIG. 7, the manual switch 115 is connected to the CPU 81. Remaining arrangement is the same as that of the first embodiment, and therefore, further description is negligible.

The tape feed roller cam 9 and the drive motor 11 are claimed feed mechanism, the thermal head 17 and the heat generating elements 18 are claimed print head, the heat generating element driver circuit 91 is the claimed print head driving means, portions of the CPU 81 and ROM 83 are claimed memory means, portions of the CPU 81 is claimed signal generation means, portions of the CPU 81, the movable projection 13, the detector 15 and the manual switch 115 are claimed switching means, and the portions of CPU 81 is the claimed control means. Further, the movable projection 13, the hole 53 and the detector 15 are the claimed discrimination means.

In view of the foregoing, according to the present invention, normal character image and reversed character image can be selectively printed on the tape like image receiving member. Therefore, the printing device of this invention is available for both non-lamination type printing and lamination type printing.

While the invention has been described in detail and with reference to specific embodiment thereof, it would be apparent to those skilled in the art that various changes and modifications may be made therein without departing from the spirit and scope of the invention.

What is claimed is:

1. A printing device for printing an image on a tape like image receiving member having a first surface and a second surface opposite to said first surface, said device comprising:

a feeding mechanism for feeding the tape like image receiving member in a first direction;

a print head having an array of a plurality of image forming elements for forming an image on the tape like image receiving member, the array extending in a second direction perpendicular to the first direction;

a single cartridge accommodation means capable of accommodating in the same position relative to said print head either a first cartridge containing therein a first tape like image receiving member to which the image is applied in a normal printing mode so as to appear proper when viewed from said first surface or a second cartridge containing therein a second tape like image receiving member to which the image is applied in a reverse printing mode so as to appear proper when viewed from said second surface, said feeding mechanism feeding both said first and second tape like image receiving members in the same direction and said print head being adjacent to said first and said second tape like image receiving member first surface;

memory means for storing therein character patterns;

a print head driving means connected to the print head for selectively driving at least one of the image forming elements in accordance with printing data and a character pattern read from the memory means;

signal generation means for generating one of normal and reverse print mode signals, in the normal print mode the tape like image receiving member comprising said first tape like image receiving member and in the reverse printing mode the tape like image receiving member comprising said second tape like image receiving member;

switching means connected to the print head driving means for reversely driving the image forming elements with respect to the second direction in order to turn the character pattern from side to side with respect to the second direction so that the printed image has a normal orientation when viewed from a back surface of the image receiving member in the reverse printing mode; and control means for selectively actuating the switching means in response to said normal and reverse printing mode signals from the signal generation means.

2. The printing device as claimed in claim 1, wherein the control means actuates the switching means when the signal generation means generates the second print mode signal which is indicative of the accommodation of the second cartridge.

3. The printing device as claimed in claim 1, wherein the signal generation means comprises a manipulation switch manipulatable to a first position indicative of the first print mode and a second position indicative of the second print mode.

4. A printing device for printing an image on a tape like image receiving member having a first surface and a second surface opposite to said first surface, said printing device comprising:

a single accommodation portion for installing thereon the tape like image receiving member, the accommodation portion commonly installing in the same position with respect to a print head a first kind of a tape like image receiving member on which a normal character image is to be printed which appears proper when viewed from said first surface and a second kind of a tape like image receiving member on which a reversed character image is to be printed which appears proper when viewed from said second surface;

a feeding mechanism for feeding said first kind of tape like image receiving member in a first direction and said second kind of tape like image receiving member in said same first direction;

a print head having an array of a plurality of image forming elements for forming the image on said first and second kind of tape like image receiving members, the array extending in a second direction perpendicular to the first direction, said print head being adjacent to said first kind of tape like image receiving member first surface or said second kind of tape like image receiving member first surface;

memory means for storing therein character patterns;

a print head driving means connected to the print head for selectively driving at least one of the image forming elements in accordance with printing data and a character pattern read from the memory means; and switching means connected to the print head driving means for reversely driving the image forming elements with respect to said second direction in order to turn the character pattern from side to side with respect to said second direction when the second kind of tape like image receiving member is installed in said single accommodating portion.

* * * * *